United States Patent [19]

Andreasen

[11] Patent Number: 4,972,556

[45] Date of Patent: Nov. 27, 1990

[54] CLOTHING CONTAINMENT ELEMENT

[76] Inventor: Jean G. Andreasen, 1082 East 6135 South, Salt Lake City, Utah 84121

[21] Appl. No.: 249,699

[22] Filed: Sep. 27, 1988

[51] Int. Cl.[5] ..... A41F 1/00

[52] U.S. Cl. ..... 24/49 S; 24/3 R; 24/129 B; 24/530

[58] Field of Search ..... 24/530, 49 S, 3 R, 30.5 R, 24/30.5 S, 265 AL, 11 CT, 129 B

[56] References Cited

U.S. PATENT DOCUMENTS

| | | | |
|---|---|---|---|
| 2,602,164 | 7/1952 | Di Venuti | 24/49 S |
| 2,941,213 | 6/1960 | Eliasberg | 24/49 S |
| 2,968,849 | 1/1961 | Cain | 24/11 CT |
| 2,975,788 | 3/1961 | Ardelyan | 24/129 B |
| 3,183,612 | 5/1965 | Romaine | 24/49 S |
| 3,748,661 | 7/1973 | Smith | 24/49 S |
| 3,924,786 | 12/1975 | Duquette | 24/3 R |
| 3,952,376 | 4/1976 | Ellis | 24/265 AL |
| 4,000,523 | 1/1977 | Woods | 24/49 SA |
| 4,038,724 | 8/1977 | Parizek | 24/49 S |
| 4,109,351 | 8/1978 | Coffey | 24/30.5 R |
| 4,237,702 | 12/1980 | Caverly | 24/49 S |
| 4,835,820 | 6/1989 | Robbins, III | 24/543 |

*Primary Examiner*—Victor N. Sakran

*Attorney, Agent, or Firm*—Thorpe, North & Western

[57] ABSTRACT

A clothing containment ring includes a rigid outer annulus and an inner ring liner formed of a non-skid friction producing material such as rubber, leather or the like. The inside wall of the annulus on which the liner is attached is formed to be generally planar in the axial direction (and of course generally circular in the circumferential direction). With this construction, gathered clothing can be inserted into the ring and thus maintained in the gathered or bunched condition by the ring.

5 Claims, 1 Drawing Sheet

CLOTHING CONTAINMENT ELEMENT

BACKGROUND OF THE INVENTION

This invention relates to a device for holding clothing or the like in a gathered, bunched condition.

It is a common sight to see a female wearing a T-shirt or similar article of clothing in which a portion of the lower edge of the article has been gathered and tied in a knot to pull and maintain the remaining portion of the lower edge tightly about the wearer's waist. In this manner, the article of clothing is held tightly, at least at the lower edge, against the wearer's body to present an attractive, form-fitting garment.

When finished wearing the article of clothing, the knot would be untied to allow removal of the article, leaving that portion which had been tied in a wrinkled condition. In addition to the inconvenience of the wrinkling, tying and untying the knot could be difficult and time consuming especially if care is taken to obtain the desired degree of snugness of the garment.

A number of structures have been suggested for holding gathered cloth in place. See, for example, U.S. Pat. Nos. 1,242,139, 3,170,213, and 4,697,312. These structures all include ring-like devices having inwardly projecting teeth or prongs designed to pierce or pinch cloth inserted through the devices. Although apparently effective, the devices may also tear or damage the cloth and are difficult to remove once put in place.

Ring-like devices have also been used to connect or join ends of straps or belt loops. See U.S. Pat. Nos. 1,127,598 and 2,246,638. These devices, however, are not adapted to efficiently hold gathered cloth together.

SUMMARY OF THE INVENTION

It is an object of the invention to provide a simple and easy to manufacture clothing containment element.

It is also an object of the invention to provide such an element which is easy to apply to and remove from gathered cloth without damaging the cloth.

It is a further object of the invention to provide such an element which, when applied to gathered cloth, grips and holds the cloth in the gathered condition.

The above and other objects of the invention are realized in a specific illustrative embodiment of a clothing containment element which includes a substantially rigid body having a centrally located, generally circular opening. Also included is a resilient, non-skid liner material disposed on the body about the periphery of the opening. Gathered cloth inserted into the opening is retained therein by the liner material which tends to grip and hold the cloth.

In accordance with one aspect of the invention, the sidewall of the opening is generally planar in the direction of the opening through the body, and the liner material is positioned to substantially cover the sidewall. The planar aspect of the opening sidewall provides for a larger opening surface area to contact and hold the gathered cloth.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 2:
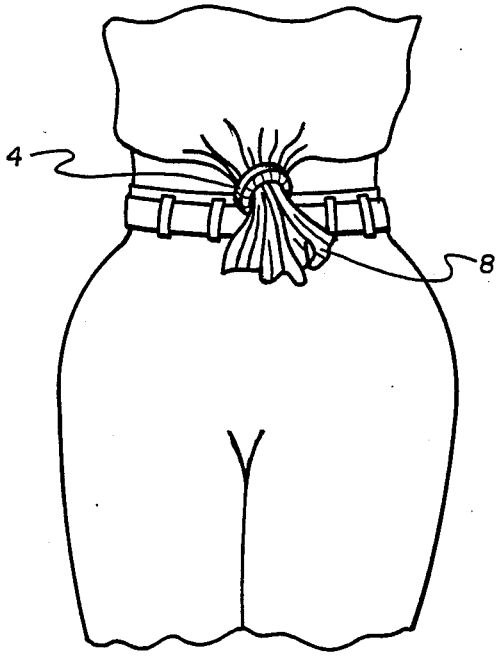
FIG. 2 shows the clothing containment element of FIG. 1 placed over the gathered, bunched lower edge of a T-shirt worn by a person (shown fragmented).

The clothing containment element of the present invention is for containing and holding clothing or other similar cloth articles in a bunched or gathered position such as shown in FIG. 2. There, a containment ring 4 is shown holding the front edge of a T-shirt 8 of a person in a gathered condition. As will be described next, the ring 4 is constructed so that it does not slip from the T-shirt or similar article of clothing, but rather maintains itself about the gathered cloth, but yet is easy to put in place over the gathered cloth and removed therefrom. Also, use of the ring 4 causes much less wrinkling and substantially no damage to gathered clothing over which it is placed.

The detail of the containment ring 4 is shown in FIG. 2 to include a substantially rigid outer annulus 12 made, for example, of wood, metal, plastic or a variety of other materials which might be readily manufactured in the annulus shape. An inner ring liner 16 is positioned on the annulus 12 about the inner periphery thereof to circumscribe the annulus opening 20. The annulus opening is substantially circular as shown in the drawing and could have various dimensions as may be needed to function as a containment element. Advantageously, the diameter of the opening 20 would be about one inch to one and a half inches.

The side wall of the opening 20, i.e., the inner peripheral wall of the annulus 12, is formed to be generally planar in the direction of the hole through the annulus (in a direction perpendicular to the plane defined by the annulus). This can be seen in FIG. 1 where the ring liner 16 is attached by an adhesive to the inner periphery of the annulus 12 to present a generally flat side wall in the axial direction and curved, circular side wall in the circumferential direction.

The ring liner 16 extends about the entire inner periphery of the annulus 12 and substantially covers the width of the opening. The ring liner 16 is made of a resilient, non-skid, friction producing material such as rubber, leather, etc. Such non-skid material clings to the bunched cloth which it surrounds and prevents the annulus 12 from slipping from off the cloth. Without the non-skid material, the annulus 12 would simply not serve to hold its place on a gathered lower edge of a T-shirt unless other measures were taken, such as providing sharp rough edges for the inner periphery of the annulus, but this might result in the cloth being snagged, torn or otherwise damaged A preferable type of non-skid material for the ring liner 16 is non-porous rubber.

Figure 1:
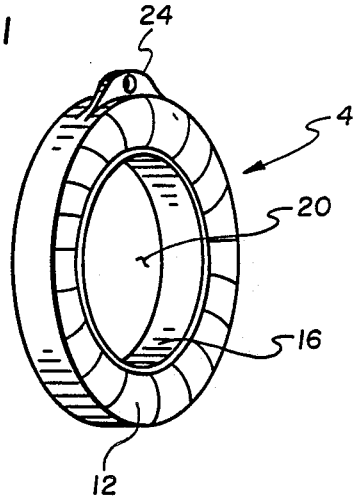
FIG. 1 is a perspective view of a clothing containment element made in accordance with the principles of the present invention.

Formed on the outer periphery of the annulus 12 is a eyelet 24 to which tags containing names, logo, or other identifying indicia could be attached. The eyelet 24 is conventional in design and shape as shown in FIG. 1.

Although the clothing containment element illustrated and described is in the form of an annulus or ring, other shapes could also be utilized such as squares, triangles, octagons, and other various closed loop figures. However, provision of a generally circular opening 20 is the preferred embodiment for better holding and securing gathered cloth therein. Also, provision of the generally planar interior side wall in the axial direction, provides a substantially large surface area for contacting the gathered cloth and better clinging and holding of the cloth.

In the manner described, a simple, easy to construct and yet efficient clothing containment element is provided for use especially on gathered and bunched lower edges of T-shirts. Of course other uses for containing gathered cloth might also be desired.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A clothing containment element comprising a substantially rigid body having a front face and a rear face;

a centrally disposed opening extending through said body from the front face to the rear face thereof for receiving a gathered portion of an article of clothing, said opening being completely circumscribed by said rigid body and having a side wall which is generally planar along the length of the opening; and a liner disposed on the side wall of said opening, with said liner being composed of a non-skid, resilient material.

2. A containment element as in claim 1 wherein said opening has a generally circular shape.

3. A containment element as in claim 1 wherein the liner substantially covers the side wall.

4. A containment element as in claim 1 wherein said liner material comprises a non-porous rubber.

5. A containment element as in claim 1 further including an eyelet formed on the periphery of the body.

* * * * *